US006823642B1

(12) United States Patent
Simpson et al.

(10) Patent No.: US 6,823,642 B1
(45) Date of Patent: Nov. 30, 2004

(54) ROOF DEMAND AND ZONE BASED ROOFING SYSTEM

(75) Inventors: Harold G. Simpson, Tulsa, OK (US); Leo E. Neyer, Edmond, OK (US); Clarence S. Salisbury, Moore, OK (US)

(73) Assignee: Harold Simpson, Inc., Tulsa, OK (US)

( * ) Notice: Subject to any disclaimer, the term of this patent is extended or adjusted under 35 U.S.C. 154(b) by 0 days.

(21) Appl. No.: 10/455,548

(22) Filed: Jun. 4, 2003

Related U.S. Application Data

(63) Continuation of application No. 09/775,480, filed on Feb. 2, 2001, now Pat. No. 6,588,170.

(60) Provisional application No. 60/196,496, filed on Apr. 12, 2000, and provisional application No. 60/180,231, filed on Feb. 4, 2000.

(51) Int. Cl.[7] ..... E04G 21/00

(52) U.S. Cl. ..... 52/745.06; 52/588.1; 52/528

(58) Field of Search ..... 52/748.1, 745.06, 52/528, 588.1, 542, 749.12

(56) References Cited

U.S. PATENT DOCUMENTS

| | | | | |
|---|---|---|---|---|
| 4,694,628 A | | 9/1987 | Vondergoltz et al. | |
| 4,759,165 A | | 7/1988 | Getoor et al. | |
| 4,987,716 A | * | 1/1991 | Boyd | 52/520 |
| 5,001,881 A | | 3/1991 | Boyd | |
| 5,201,158 A | | 4/1993 | Bayley et al. | |
| 5,247,772 A | | 9/1993 | Greenberg | |
| 5,259,166 A | | 11/1993 | Carey, II et al. | |

* cited by examiner

*Primary Examiner*—Carl D. Friedman
*Assistant Examiner*—Naoko Slack
(74) *Attorney, Agent, or Firm*—Fellers, Snider, et al.; Bill D. McCarthy

(57) ABSTRACT

A system for constructing a roof on a roof support structure comprising (a) identifying and mapping the roof by zones of demand requirements throughout the area to be covered by the roof; (b) covering the area with metal panels; (c) choosing a connecting process for connecting side-adjacent and end-adjacent panels, wherein a connecting process is selected for each demand zone to inter-connect the side-adjacent and end-adjacent panels that satisfies the performance requirements of that particular demand zone so that all of the metal panels are inter-connected to each other and to the roof support structure.

20 Claims, 11 Drawing Sheets

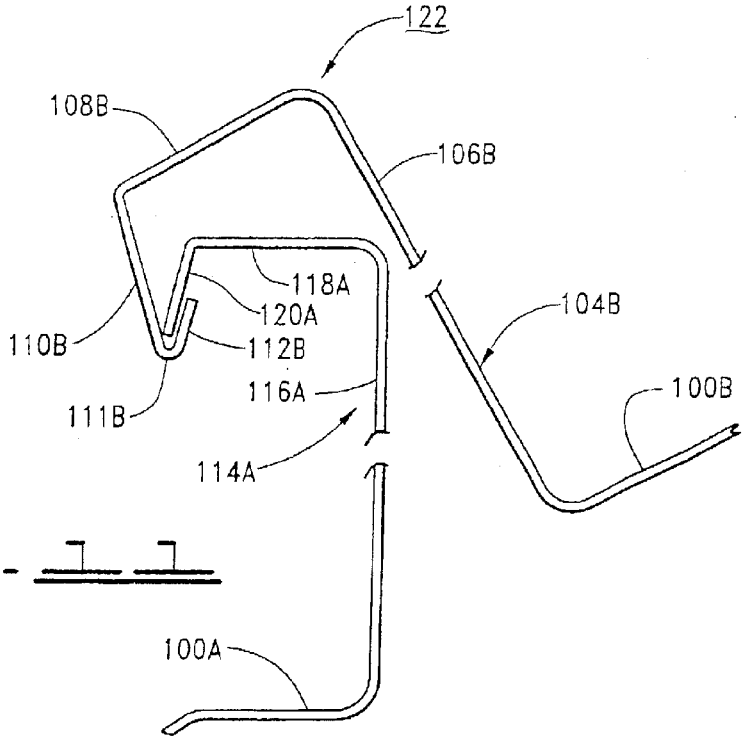
FIG. 11
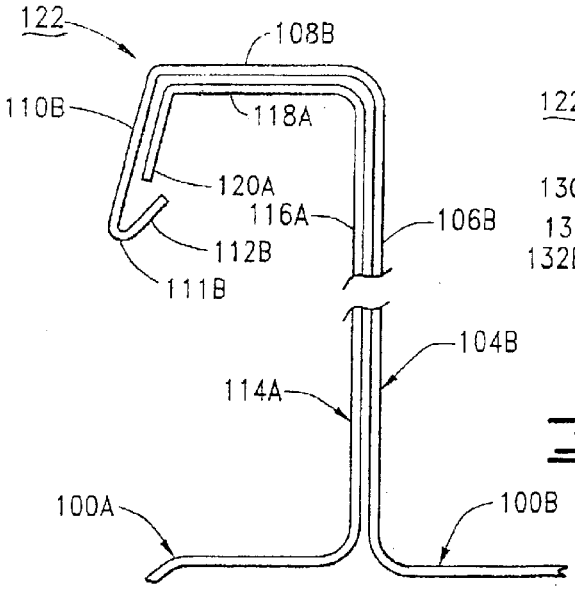
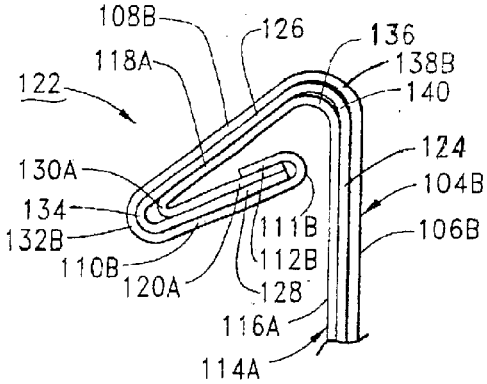
FIG. 14
FIG. 12

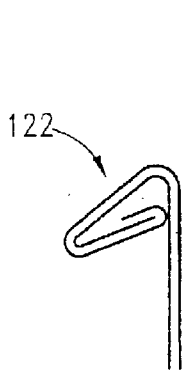
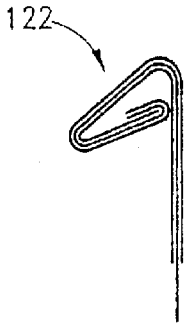
FIG. 15B
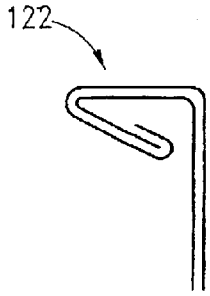
FIG. 15A
FIG. 15C
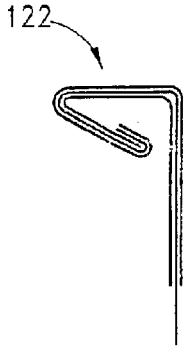
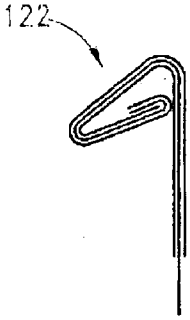
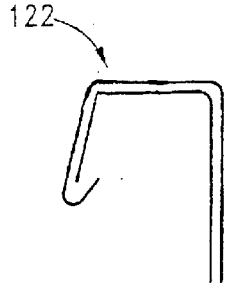
FIG. 15E
FIG. 15D
FIG. 15F

| LETTER DESIGNATION FOR TYPE OF SEAM | TYPE OF SEAM |
|---|---|
| A | CONTINUOUS QUADRILOCK SEAM |
| B | COMBINATION QUADRILOCK AND TRIPLE-LOCK SEAM (CONTINUOUS TRIPLE-LOCK SEAMING WITH QUADRILOCK AT CLIPS) |
| C | CONTINUOUS TRIPLE-LOCK SEAM |
| D | COMBINATION ELASTIC-AND-QUADRILOCK SEAM (CONTINUOUS TRIPLE-LOCK SEAMING WITH QUADRILOCK AT CLIPS) |
| E | COMBINATION ELASTIC AND TRIPLE-LOCK SEAM (CONTINUOUS ELASTIC SEAMING WITH TRIPLE-LOCK AT CLIPS) |
| F | ROLL-AND-LOCK SEAM (ELASTIC SEAMING) |

FIG. 16

| COMPOSITE ZONES | WIND ZONE | SEAM | LEAK ZONE | SEAM | SNOWDRIFT ZONE | SEAM | COMPOSITE ZONE |
|---|---|---|---|---|---|---|---|
| FIG. 7 | FIG. 4 | | FIG. 5 | | FIG. 6 | | |
| 601 | 301 | B | 401 | F | 501 | F | B |
| 602 | 302 | C | 401 | F | 501 | F | C |
| 603 | 303 | B | 401 | F | 501 | F | B |
| 604 | 304 | C | 401 | F | 501 | F | C |
| 605 | 305 | F | 401 | F | 501 | F | F |
| | | | | | | | |
| 606 | 306 | C | 401 | F | 501 | F | C |
| 607 | 304 | C | 401 | F | 502 | C | C |
| 608 | 305 | E | 401 | F | 502 | C | C |
| 609 | 306 | C | 401 | F | 502 | C | C |
| 610 | 304 | C | 402 | A | 502 | C | A |
| | | | | | | | |
| 611 | 305 | F | 402 | A | 502 | C | A |
| 612 | 306 | C | 402 | A | 502 | C | A |
| 613 | 307 | B | 402 | A | 502 | C | A |
| 614 | 308 | C | 402 | A | 502 | C | A |
| 615 | 309 | B | 402 | A | 502 | C | A |

FIG. 17

| SEAM | RELATIVE COST LOWEST (1) TO HIGHEST (6) | RELATIVE WIND UPLIFT RESISTANCE LOWEST (1) TO HIGHEST (6) |
|---|---|---|
| ROLL-AND-LOCK (ELASTIC SEAMING) | 1 | 1 |
| COMPINATION ELASTIC-AND-TRIPLE-LOCK (CONTINUOUS ELASTIC SEAMING WITH TRIPLE-LOCK AT CLIPS) | 2 | 2 |
| CONTINUOUS TRIPLE-LOCK | 3 | 3 |
| COMPINATION ELASTIC-AND QUADRILOCK (CONTINUOUS ELASTIC SEAMING WITH QUADRILOCK AT CLIPS) | 4 | 4 |
| COMPINATION TRIPLE-LOCK AND QUADRILOCK (CONTINUOUS TRIPLE-LOCK SEAMING WITH QUADRILOCK AT CLIPS) | 5 | 5 |
| CONTINUOUS QUADRILOCK | 6 | 6 |

FIG. 18

| SEAM | RELATIVE COST LOWEST (1) TO HIGHEST (6) | RELATIVE WATERTIGHTNESS LOWEST (1) TO HIGHEST (6) |
|---|---|---|
| ROLL-AND-LOCK (ELASTIC SEAMING) | 1 | 1 |
| COMPINATION ELASTIC-AND-TRIPLE-LOCK (CONTINUOUS ELASTIC SEAMING WITH TRIPLE-LOCK AT CLIPS) | 2 | 2 |
| CONTINUOUS TRIPLE-LOCK | 3 | 3 |
| COMPINATION ELASTIC-AND QUADRILOCK (CONTINUOUS ELASTIC SEAMING WITH QUADRILOCK AT CLIPS) | 4 | 4 |
| COMPINATION TRIPLE-LOCK-AND-QUADRILOCK (CONTINUOUS TRIPLE-LOCK SEAMING WITH QUADRILOCK AT CLIPS) | 5 | 5 |
| CONTINUOUS QUADRILOCK | 6 | 6 |

FIG. 13

ROOF DEMAND AND ZONE BASED ROOFING SYSTEM

RELATED APPLICATIONS

The present application claims priority to provisional application No. 60/180,231, filed Feb. 4, 2000; to provisional application No. 60/196,496 filed Apr. 12, 2000; and is a continuation of patent application Ser. No. 09/775,480 filed Feb. 2, 2001, now U.S. Pat. No. 6,588,170.

BACKGROUND OF THE INVENTION

1. Field of the Invention

The present invention relates to standing seam metal roofs, and more particularly but not by way of limitation, to a roofing system based on roof demand and zone determination.

2. Discussion

Metal panels are common architectural features for a class of buildings commonly called pre-engineered buildings. The roofs of such buildings are usually made of metal panels that are mounted on, and cover up, the structural members of the building, which are usually purlins, the metal panels making up the external roof facade. The metal roof panels serve both as functional and as aesthetic features of such buildings.

Further, all roofs have multiple functional demands that such roofs must meet. To understand the scope of such demands, it should be noted that a roof function can be viewed as any one of a set of qualities or traits that are desirable or required for a roof in its particular location. A roof function is any requirement that a building code, regulatory agency, governing agency or authority, a specifier or a customer may demand, require, conceive or specify for the roof, or for any portion thereof. A demand is the particular level of performance required of a roof to meet its requirement for a particular function.

Within these parameters, "demand zones" are those areas of a roof that require or that perform different levels of the functional performance required of the whole. Also, a "demand zone quality level" is the level of quality that a specific demand zone should possess to meet the imposed qualify for the specific area or location of the roof. Of course, it will recognized that demand zones for various functions can coincide or overlap.

As one considers a roof in its multi-layered functional performance requirements, it will be appreciated that the quality required by a roof will vary from zone to zone over a range of quality levels for the type of roof being constructed. Within the scale of quality levels imposed on a particular roof design, and as used herein to describe the quality selection for a discrete zone, the term "over qualified demand zone" will mean that such zone has a level of performance that meets the design requirements of at least the next higher demand zone quality level imposed by the design requirements for the roof.

In describing the present invention, it is desirable to deal with the broader aspect of a roof zone, while at the same time, dealing with specific variants or attributes that are available to a designer to achieve the required performance level specified or required for any particular roof. Thus, the variant of panel to panel seaming is useful to illustrate one method available to the designer to optimize performance and cost effectiveness. Likewise, the variant of panel wind uplift resistance is useful to illustrate one method available to the designer to optimize performance and cost effectiveness of the performance of one roof function.

Broadly, a roof shelters the interior of a building from the natural elements of wind, sun, rain and snow, and with the building walls, encloses the building interior for environmental control. Numerous types of metal panel roofs have been utilized to resist these elements of nature while permitting the metal panels to face the constant demands imposed by their environment.

The purlin members supporting the metal roof panels are themselves typically supported by rafters that extend from the roof eaves to the ridge peak. The purlins serve as underlying cross members that are interconnected to extend the length of the building.

Metal roofs can be classified by the manner in which the side-adjacent and end-adjacent overlapping panels are sealed at joints. "Shed roofs" are roofs that shed water and achieve water tightness because gravity pulls the water down and away from panel joints more effectively than wind or capillary action can propel water through the joints. On the other hand, "gasket roofs" are made watertight by gasket material disposed between the panel joints and secured in place by encapsulating pressure imposed against the gasket material. Generally, gasket roofs can be installed where the roof slope is down to about 1 to 48.

An environmental condition encountered by all roofs is the load imposed by ambient wind conditions. Wind passing over a roof peak often creates reduced pressure immediately above the roof, resulting in a pressure gradient on the panels, with lower pressure above the roof than below. This pressure gradient causes an uplift force on the metal roof panels, causing the panels to be pulled upwardly and away from the purlins. This often is the primary cause of failure for metal roofs.

There are a number of apparatuses that affect the quality of performance and that can be selectively varied by varying the specific configuration of the apparatus to achieve a desired performance level of metal roofs. This can be illustrated by considering the means by which standing seam roof panels can be joined together in their side to side, and end to end, arrangements and mounted to their underlying support structure. As known in the art, standing seam roof panels are designed to withstand environmental elements such as wind, snow and rain, and since a metal roof is essentially a large area heat sink continually exposed to atmospheric weather conditions, the standing seam panels must accommodate thermal expansion and contraction over a wide range of ambient temperature.

Standing seam roof panels have interlocking sidelap portions, a female sidelap portion of one panel engaging and locking with a male sidelap portion of a side-adjacent panel. As used herein, the term "side-adjacent" is meant to indicate that a first panel is disposed to lay along side, and adjacent to, a second panel on the roof. The female and male sidelap portions of the panels are elevated, or standing, to extend upwardly from a central flat or corrugated medial portion of the panels.

The metal panels are attached to the supporting purlins by clips that engage the standing seams, and by fasteners that penetrate and extend through the panels. The fasteners, sometimes referred to as through-fasteners, typically are sheet metal screws that extend through the medial portions of the panels to attach to the purlins, preventing differential movement between the panels and supporting purlins.

Clips are devices that connect the standing seam joints, that is, the interlocked standing sidelap portions, to the supporting purlins. Both fixed and sliding clips are utilized. Fixed clips are metal devices that attach to the underlying purlins and to the side-adjacent metal panel standing seams. Sliding clips, also referred to as floating clips, attach to the side-adjacent metal panels at the standing seams and to the underlying purlins while permitting a degree of differential movement between the panels and the purlins. The selection of the type and spacing of such clips has a pronounced effect on the performance of several of the roof functions, as well as affecting the cost, of metal roofs.

The interlocking engagement of the sidelaps of the metal panels provide functional requirements such as stiffness and strength to a flexible roof structure. The use of floating clips allows the roof structure to expand and contract as a function of the coefficient of thermal expansion of the panel material, and the temperature cycles of the roof panels.

Another apparatus or mechanism providing several variants that determine the performance quality of a metal roof is that of the type of seaming process selected to interlock and seam the side-adjacent, and end-adjacent, panels. Several types of seaming processes have been developed for interlocking the sidelaps of adjacently disposed panels. Most such seaming processes involve the operation of inelastically bending or rolling portions of the female sidelap and the male sidelap together. This inelastic or plastic deformation of the sidelap portions forms interlocked joints, or locks, of varying strength. That is, the interlocked sidelaps can be rolled multiple times so as to increase resistance to unfurling, and generally, the more times the interlocked sidelaps are rolled or plastically deformed, the more resistant the lock will be to unfurling. However, stronger locks are obtained by a corresponding increase in the cost of manpower and equipment to perform the bending or locking operation.

As noted above, for any given roof configuration and its supporting structure, the quality of a particular zone of a roof is often a function of several attributes, such as the type of seaming between side-adjacent panels, the clip attachment, frictional resistance to one side adjacent male sliding line with its corresponding female. With regard to the seaming attribute in a particular range or scale of quality, most would agree that a standing seam roof having the lowest quality on such scale of quality would be that roof having seam joints that are the weakest with respect to wind uplift and that are the least watertight. On the other end of such scale of quality, a standing seam roof having the highest quality would be the roof having seam joints that are the strongest with respect to wind uplift and are the most watertight.

In the art, sidelap seaming currently follows the practice of roll seaming adjacent sidelaps from one end of the panels to the other end of the interlocked panels. Only when the seaming machine malfunctions is this practice altered, in that the seaming machine is restarted at the point of malfunction and the seaming is completed as much as possible as though the malfunction had not occurred.

Many factors must be considered in the design and selection of a standing seam roof for a specific building. Of primary concern is the roof performance criteria, which may be determined by the geographic location of the building and the typical weather conditions expected during the life of the building. Modem day building codes impose many different requirements for the roof of a building. Codes include requirements for live loads, dead loads, snow loads, wind loads and earthquake loads.

Further, it is known that different areas or zones of the roofs typically are subjected to different loadings, especially with regard to wind uplift. Also, watertightness is often more critical in some areas than in others and is a major concern in valleys and other low spots.

The non-utilitarian, or aesthetic, aspect of metal roofs must also be considered, as roof appearance is often important when deciding the kind and amount of joint seaming that will be used to interlock the roof panels. Generally, roofs are more aesthetically pleasing when less elastic deforming is used at the panel sidelaps.

Considering these design factors, it has been the practice in most instances to determine the most critical portion of the roof and to require that all portions of the roof meet the design parameters of the most critical portion of the roof. The result of this approach is that the design specifications for the other less demanding portions of the roof exceed that which is necessary. This approach results in an unnecessary increase in the cost of the roof. Thus, there is a need for a roof that meets the requirements of all zones of all functions of the roof, minimizes the cost of the roof and is aesthetically acceptable.

SUMMARY OF THE INVENTION

The present invention provides a metal panel roof that uses different types of connecting processes as required to meet the demand requirements for the zones of performance demands for the completed roof.

A system is herein provided for constructing a roof on roof support structures which involves (a) identifying and mapping the roof by zones of demand requirements throughout the area to be covered by the roof, and (b) covering the area with metal panels or the like. It also involves the steps of choosing connecting processes for the side-adjacent and end-adjacent panels for all of the demand zones, with a zone specific connecting process selected for each demand zone and wherein the zone specific connecting process meets the performance criteria for that particular demand zone. Finally, the metal panels are inter-connected to each other and connected to the supporting roof support structures in each demand zone by the zone specific connecting process that meets all of the demand requirements for the demand zones. so that all of the metal panels are inter-connected to each other and to the roof support structure.

For example, a metal panel roof is zone mapped for performance requirements according to the functional performance required of its demand zones. The metal panels are attached to the underlying roof support structure and elastically seamed together by a roll-and-lock seam in accordance with a seaming type assigned to each zone. Next, the minimum quality of seaming is determined that meets the functional performance requirements of the multiple demand zones. Finally, the side-adjacent metal panels are seamed together by that seaming process that both meets the seam quality required for the demand zone and does so at the least cost. The end adjacent metal panels are also joined together so as to achieve consistent quality and cost as that of the side-adjacent seams.

The features, advantages and advantages of the present invention will be made apparent from the description provided herein below when read in conjunction with the accompanying drawings and claims.

BRIEF DESCRIPTION OF THE DRAWINGS

FIG. 11 is a second elevational end view of the panels of FIG. 8 with the panel assembly progressively continuing, FIG. 12 is a third elevational end view of the panels of FIG. 8 with the panel assembly progressively continuing.

FIG. 14 is an elevation end view of the panels of FIG. 8 with a clip secured thereto and having been progressively seamed further in accordance with the present invention.

FIG. 15A depicts a quadrilock seam profile corresponding to the detail 15A shown in FIG. 15 without a clip attached thereto.

FIG. 15B depicts a combination triple-lock-and-quadrilock seam profile corresponding to the detail 15B shown in FIG. 15, for which there is continuous triple-lock seaming with quadrilock seaming at the clips.

FIG. 15C depicts a triple-lock seam profile corresponding to the detail 15B shown in FIG. 15.

FIG. 15D depicts a combination elastic-and-quadrilock seam profile corresponding to the detail 15D shown in FIG. 15, for which there is a roll-and-lock seam with a quadrilock seam at the clips.

FIG. 15E depicts a combination elastic-and-triple-lock seam profile corresponding to the detail 15E shown in FIG. 15, for which there is a roll-and-lock seam with a triple-lock seam at the clips.

FIG. 15F depicts a roll-and-lock seam profile corresponding to the detail 15F shown in FIG. 15.

FIG. 16 provides a table showing designation of demand zones for types of seaming.

FIG. 17 provides a table of types of seaming required for wind zones.

FIG. 18 is a chart showing the relative cost and effectiveness for different seams in response to wind uplift forces.

FIG. 19 is a chart of relative cost and effectiveness for different seams with regard to water tightness.

DESCRIPTION

As mentioned above, many factors must be considered in the design of a commercial grade building. All construction materials, including roofing panels, must meet the environmental conditions that are likely to be encountered by the building. For those companies that supply such materials, the usual practice has been to make available, and often to inventory, a large selection of metal building components for selection by building erectors to meet the demand requirements for each building installation.

The reality of construction design is that, with few exceptions, the requirements for most geographical areas is expressed in Federal, State and local building codes. Such codes deal with such requirements as both live and static loads; snow loads; wind loads; earthquake loads; etc. In light of such design factors, it has been the practice in most instances, once the requirements for the most critical portions of the panels for the roof have been established, the roof is constructed so that all panel portions of the roof meet the design parameters of the most critical portions of the roof. This has meant that final design specifications for less demanding portions of a roof will exceed the requirements for such portions. Thus, this construction approach leads to a more expensive roof than that which would have been constructed had it not been overbuilt to meet the most rigorous demand requirements throughout. Thus, there is a need for a roof erection system by which a roof can be erected to meet all the performance demands of the roof while not overbuilding such roof; that is, the roof erected by such system would meets the requirements of every demand zone throughout the area of the roof, while also minimizing the cost of the roof.

Figure 1:
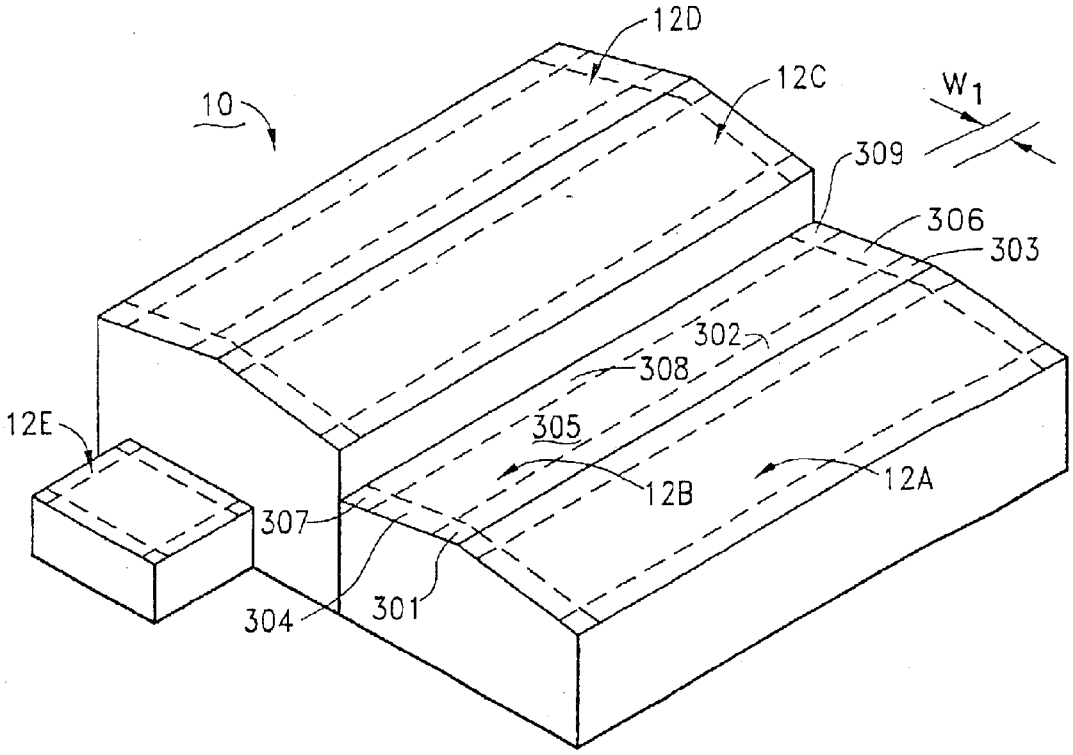
FIG. 1 is a perspective view of a building with a metal panel roof and indicating the physical zones of the roof subjected to varying wind loads.

Shown in FIG. 1 is a typical pre-engineered building 10 that has a roof 12 having several roof portions 12A, 12B, 12C, 12D and 12E. For purposes of the environmental conditions, such as wind forces, that the roof 12 will encounter, the roof portion 12B can be considered as having wind zones 301 through 309. For an actual application of the method for providing a roof, the wind zones 301 through 309 typically will be established by applicable building codes, engineering analysis, computer modeling and empirical testing. It will therefore be appreciated that the wind zones 301 through 309 are shown in a simplified format in the drawings in order to clarify the explanation of how the method described herein, and the present invention is not limited to these example mappings of the demand zones of the roof 12.

FIG. 16 provides a table of corresponding letter designations A through F for different types of seaming, with A being the strongest for a continuous quadrilock seam and F being the least strong for a roll-and-lock seam. The table provided in FIG. 17 shows, in column 3, the types of seaming required for the wind zones 301–309. In the areas of greater wind uplift, stronger seam are used.

Water leaks are generally the result of rainfall intensity, wind-driven rainstorms or melting snow or ice that results in dams. The water dams upslope of a snow or ice drift; or as a result of wind forces preventing the water from running freely off the roof; or where water collects because of compound roof slopes or length of run. These conditions can cause water ponding with sufficient water pressure to penetrate the roof. Accordingly, the roof portions 12A–12E of the building 10 can be divided into those areas that are more and less likely to leak. The water-tightness of the more likely areas can be increased above the other less likely areas by selecting an appropriate seam apparatus that will achieve greater water-tightness for such areas more likely to leak.

Figure 2:
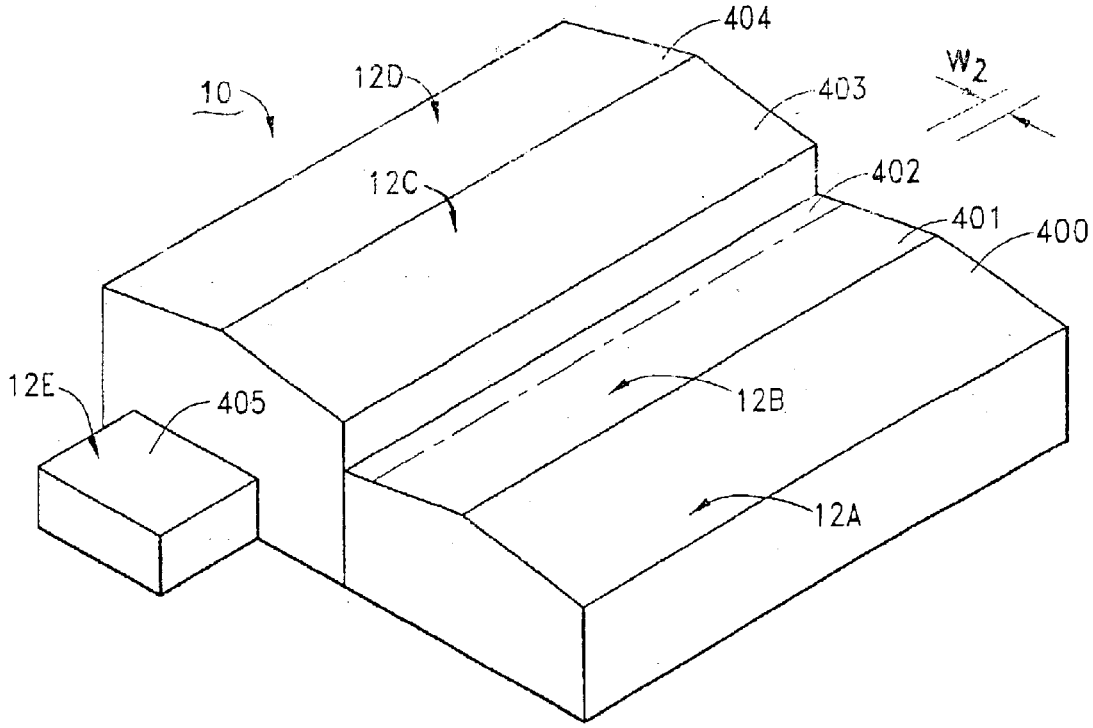
FIG. 2 is a perspective view of the building of FIG. 1, indicating the potential leak zones of the roof that can be critical with regard to invasion of wind-driven rain leaks.

FIG. 2 shows the potential leak zones for roof portion 12B of the building 10. The zone with the least potential for a water leak is zone 401, while the zone for the greatest potential for water leak is zone 402. The seaming required for each zone is provided in column 5 of FIG. 17.

Snowdrift zones of a roof are classified with respect to the tendency of snowdrifts to accumulate on the roof. The forming of snowdrifts is a problem, not only because of the increased static load associated therewith, but also because the likelihood of water damming as the snow melts and ice dams sliding down the roof as the lower side of the ice mass loosens because of heat flow from the inside of the roof. Corrosion, corrugation damage and water-head, as well as other related problems, are thus presented.

Figure 3:
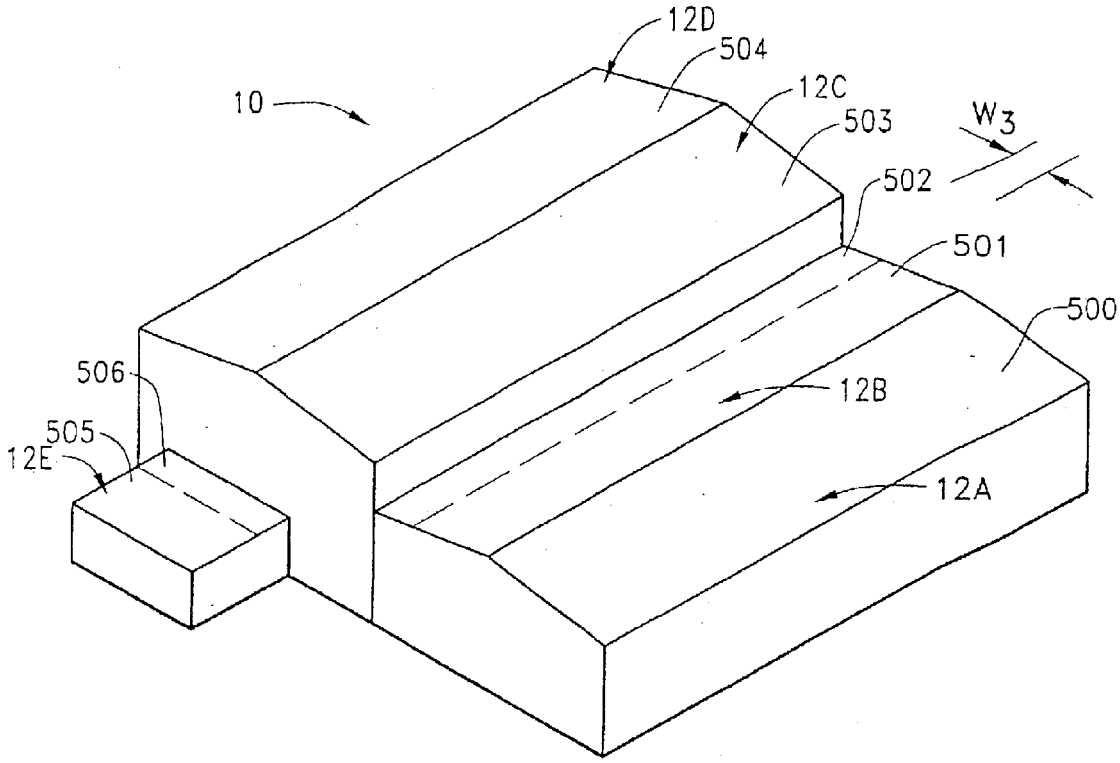
FIG. 3 is a perspective view of the building of FIG. 1, indicating the snowdrift zones of the roof subject to probable snow buildup and the zones having potential water damming with snow melting.

The snowdrift zones are shown mapped in FIG. 3. The least potential for snowdrift formation is at zone 500, and the greatest potential for snowdrift formation is at zone 502. The seaming process associated with each snowdrift zone is provided in column 7 of the FIG. 17.

Figure 4:
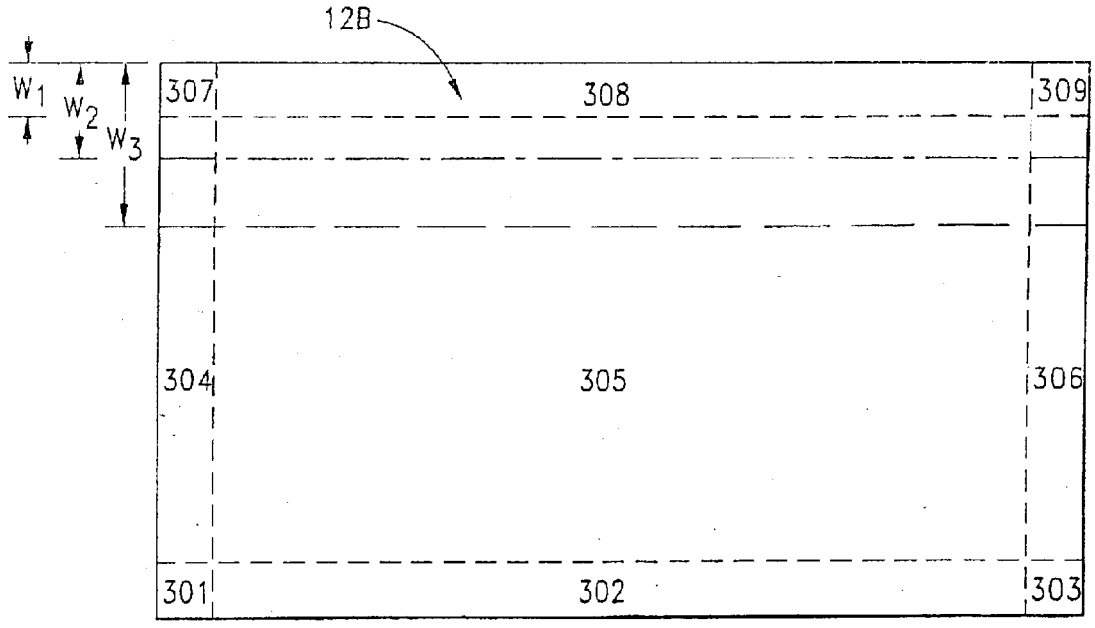
FIG. 4 is a top view of roof 12B of FIG. 1, indicating the wind zones of the roof corresponding to different amounts of wind uplift force.
Figure 5:
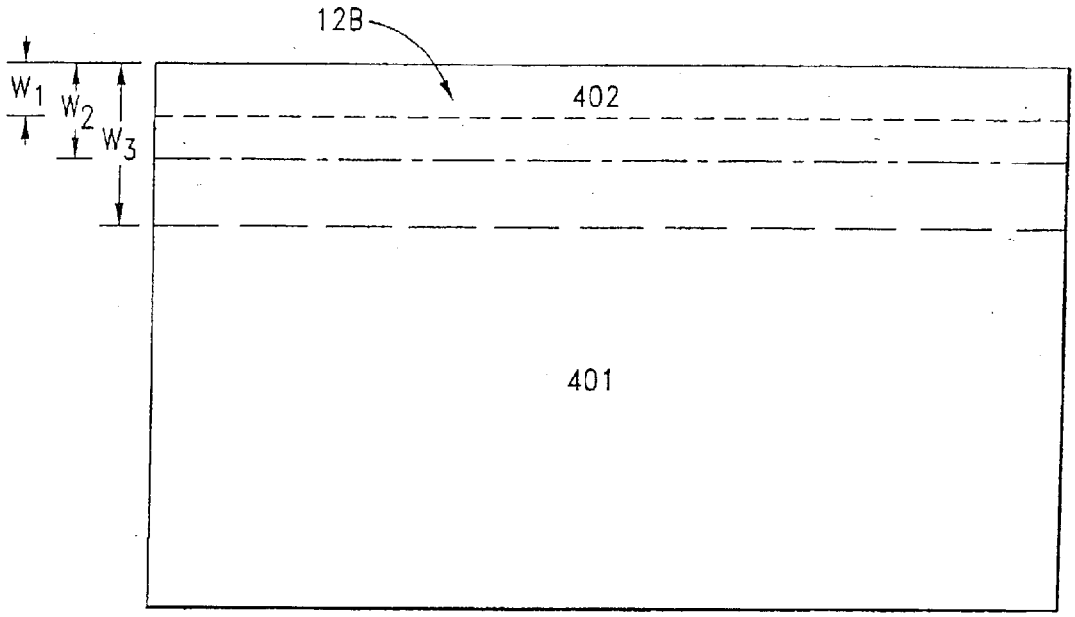
FIG. 5 is a top view of roof 12B shown in FIG. 1, indicating the potential leak zones critical with regard to invasion of wind-driven rain leaks.
Figure 6:
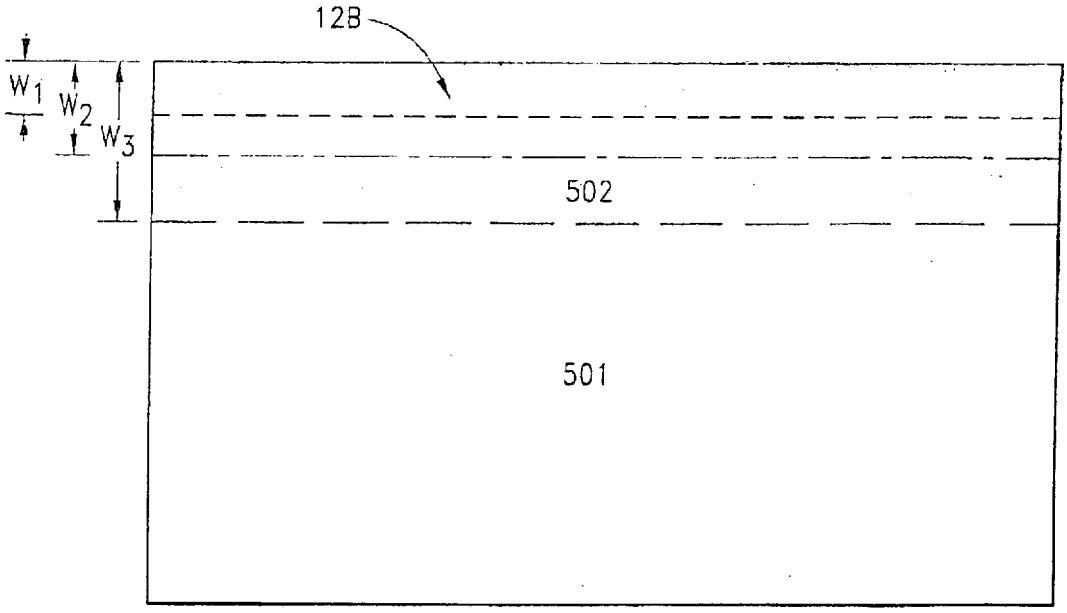
FIG. 6 is a top view of roof 12B shown in FIG. 1, indicating the snowdrift zones of the roof subject to probable snow buildup and the zones having potential water damming with snow melting.
Figure 7:
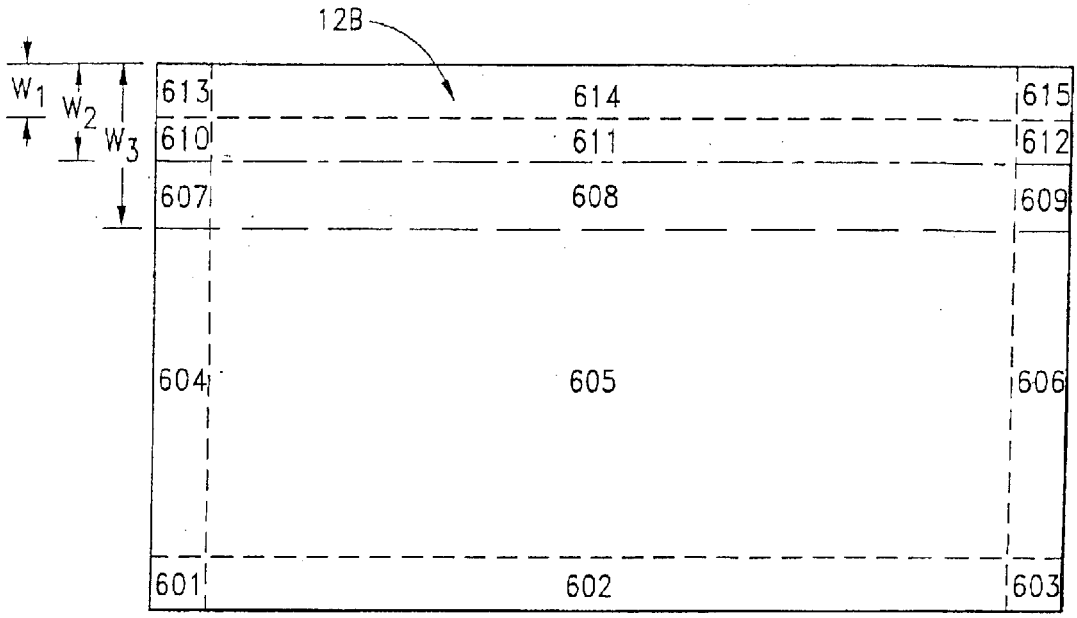
FIG. 7 is a top view of roof 12B shown in FIG. 1, showing a composite mapping of the zones mapped individually in FIGS. 4–6.

FIGS. 4 through 6 provide top views of the demand zones shown in FIGS. 1 through 3 for the roof portion 12B of the building 10. FIG. 7, a composite mapping of the various detailed demand zones of FIGS. 4–6, is prepared so that all the demand zones are determined with respect to each other and with respect to the physical dimensions of the roof. The zones produced by the composite map of FIG. 7 are called composite zones, and are listed in column 1 of the table of FIG. 17. The seams chosen to satisfy all the minimum requirements of the different demand zones are referred to as composite seams and are listed in column 8 of the table of FIG. 17.

To determine the composite seam chosen for a particular composite zone, one first examines the seams chosen for the wind zone, the leak zone, and the snowdrift zone. Then, the composite seam is chosen to be the least expensive seam that will meet the requirements of all the functional requirements of these demand zones. For example, as related to seam strength, and as depicted in the table of FIG. 16, the strongest seam is a quadrilock seam (A) and the weakest seam is the roll-and-lock seam (F).

For example, referring again to the table of FIG. 17, composite zone 608 requires: (1) a combination elastic-and-triple-lock seam E to meet the minimum requirements for the wind zone 305; (2) a roll-and-lock seam F to meet the minimum requirements of the leak zone 401; and (3) a triple-lock seam C to meet the minimum requirements of the snowdrift zone 502. To meet the requirements of all three demand zones, the snowdrift zone 502 is controlling. Thus, the triple-lock seam C is used, the triple-lock seam C being of higher seam quality that of seams E and F.

The selection of seaming processes to match the various demand zones depicted in the table of FIG. 17 is meant to be an example only. The actual seaming process chosen for a roof depends on many variables including prevailing wind data, the height of the building, the shape and slope of the roof, the nearness to other structures, and the occupancy of the building.

In the past, when a contractor provided a roof to meet different demand zones, the contractor had to either: (1) over-design portions of the roof to meet the most s stringent demand zone, or (2) order different panel widths or material thickness of metal roof panels for the different zones. In the case of over-designing the roof, the contractor would look at mappings such as shown in FIGS. 4–6 and the table of FIG. 17, and require that all the seams be seamed by a continuous quadrilock process. This greatly increased the cost of the roof. If the contractor chose to use different materials in different zones, that greatly added to the cost of the roof because different materials often require different types of roll-forming tools that have to be made available at the job site.

The present invention provides a universally acceptable metal roof panel that can be utilized to form all of the zones of the roof portions 12A–12E depicted in FIGS. 1 through 3 and discussed above. That is, a universally acceptable metal roof panel can be adapted to meet the varying loading requirements for all of the zones of the roofs 12, 12A and 12B.

Figure 8:
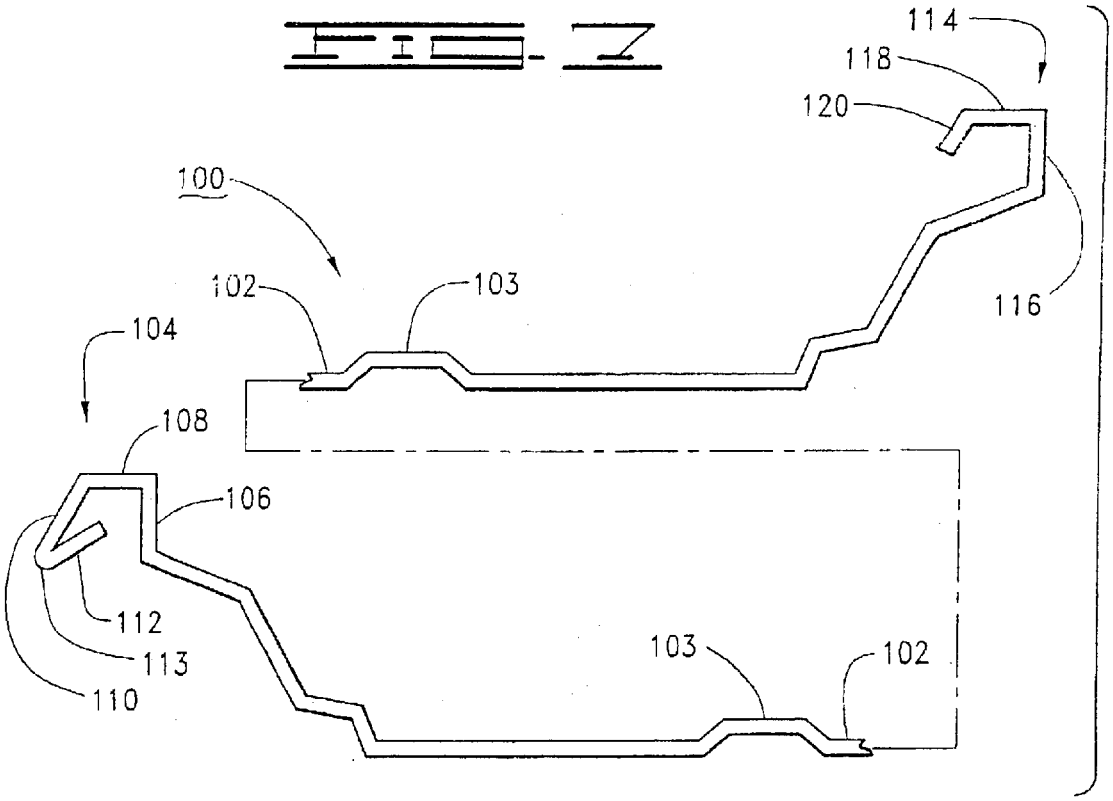
FIG.8 is an elevation end view of a universal roof panel constructed in accordance with the present invention.

Such a universal panel will now be described with reference to FIGS. 8 through 14. Shown in FIG. 8 is a metal roof panel 100 having a substantially flat medial portion 102, the medial portion 102 having a pair of corrugations 103 that serves to strengthen the panel 100. Although the particular examples embodiment shown has corrugations, the corrugations are considered optional features.

The panel 100 has a first female sidelap 104 formed with a first vertical trunk 106 and a first leg 108 extending from the first vertical trunk 106. A first foreleg 110 with a hook 112 extends from the first leg 108. The hook 112 has a base 113.

A second male sidelap 114 of the panel 100 has a second vertical trunk 116 and a second leg 118 extending therefrom. A second foreleg 120 extends, as shown, from the second leg 118.

Figure 9:
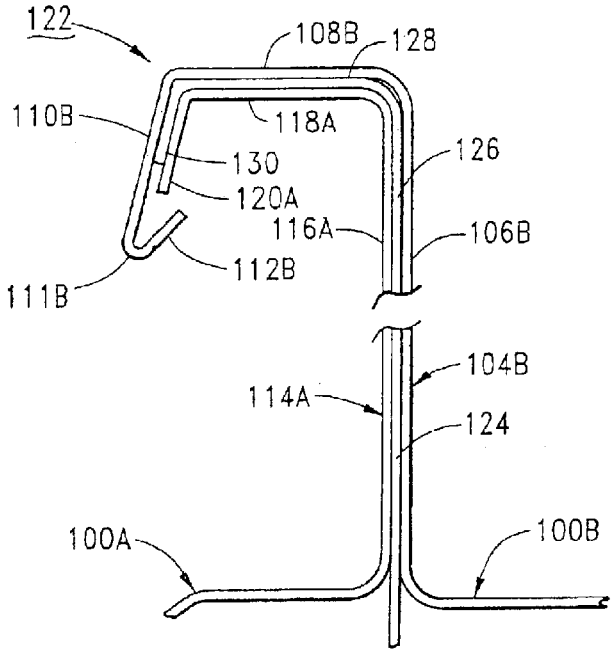
FIG. 9 is an elevation end view of an interlocked pair of the roof panel of FIG. 8, showing a portion of a clip secured thereto.

Shown in FIG. 9 is an interlocking joint 122 formed by adjacently disposed two roof panels 100A and 100B identical in construction to the roof panel 100 above described, and a clip tab 124 (shown in part) is disposed therebetween.

As will be understood, the roof panels 100A, 100B (shown in part) and the clip tab 124 are supported by, and attach to, underlying support members, such as purlins (not shown).

The second male sidelap 114A of the roof panel 100A has a second trunk 116A and a second leg 118A extending from the second vertical trunk 116A, and the second foreleg 120A extends from the second leg 118A. The first female sidelap 104B of the roof panel 100B includes the first vertical trunk 106B and a first leg 108B extending therefrom. A first foreleg 110B with a hook 112B and base 113B extends from the first leg 108B.

The clip tab 124, disposed between the second male sidelap 114A (of the roof panel 100A) and the first female sidelap 104B (of the roof panel 100B), has a trunk 126 and an extending clip leg 128 extending therefrom. As noted above, the clip tab 124 is secured via a clip base (not shown) to the underlying support structure of the building. Clip tang 130 of the clip tab 124 may be extended to lock around the distal end of the male distal end 120A. In an actual installation, multiple clips identical to the clip tabs 124 are disposed at spaced apart intervals along the joint 122.

Figure 10:
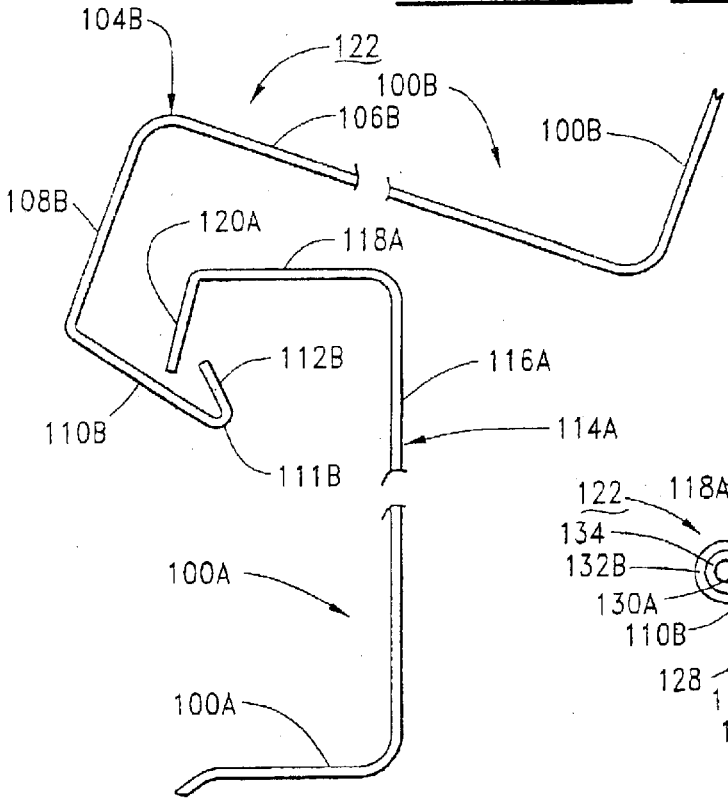
FIG. 10 is a first elevational end view of the panels of FIG. 8, showing the roll-and-lock seam thereof as the panels are being assembled.

FIGS. 10–12 illustrate how the two roof panels 100A and 100B are assembled. In FIG. 10, workmen have secured the first roof panel 100A in its stationary position and lifted and disposed the second roof panel 100B to engage the first roof panel 100A. In the position shown in FIG. 10, the workmen have raised and positioned the second panel 100B so that the hook 112B is about to engage the second foreleg 120A. The workmen use the point of contact (in the two-dimensional view) of the hook 112B and the second foreleg 120A as an axis of rotation to lower the second panel 100B. In the intermediate position shown in FIG. 11, the second panel 100B has been rotated downwardly to the point where the second foreleg 120A is positioned in a slot defined by the hook 112B, the base 111B and the first foreleg 120B. As shown in FIG. 12, the workmen continue to rotate the second panel 100B until the flat medial portion 102B (not shown) is supported by the roof support structure.

The seam shown in FIG. 12 is referred to as a roll-and-lock-seam, with roll referring to the rotation process described above that workmen use to engage the two panels 100A and 100B. As shown in FIG. 12, no permanent deformation has occurred. That is, the shapes of the sidelaps 114A and 104B of the roof panels 100A and 100B are substantially the same as when originally formed. The locking action occurs from elastic deformation of the panel sidelaps 114A and 104B to engage one another, gripping the clip tab 124 therebetween. The roll-and-lock seam is also referred to as an elastically locked seam. Typically, the roll-and-lock seam, and all other seams described herein, are further sealed from water penetration by a joint sealant (not shown).

Figure 13:
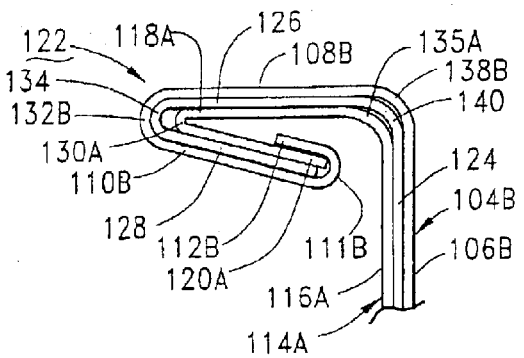
FIG. 13 is an elevation end view of the panels of FIG. 8 with a clip secured thereto and having been seamed to form a multiple-lock seam in accordance with the present invention.

In FIG. 13, a detailed view is shown of clip tab 124 disposed between the second male sidelap 114A of the first panel 100A and the first female sidelap 104B of the second panel 100B. A bending tool has been used to simultaneously bend the second male sidelap 114A of the first panel 100A, the clip tab 124, and the first female sidelap 104B of the second panel 100B at first panel elbow 130A, second panel elbow 132B and clip elbow 134. The bending of these parts together causes non-elastic, or plastic, deformation of each part and acts to form a secure connection between the first panel 100A, the second panel 100B and the clip tab 124.

Non-elastic deformation refers to bending that stresses portions of the material to a point beyond the yield point so that the material remains deformed after the stress has been removed. The seam shown in FIG. 13 represents a triple-lock seam formed by a triple-lock seaming process.

In FIG. 14, a detailed view is shown of the clip tab 124 disposed between the second male sidelap 114A of the first panel 100A and the first female sidelap 104B of the second panel 100B. A bending tool has been used to simultaneously bend the second foreleg 120A with respect to second leg 118A, to bend the clip foreleg 126 with respect to the clip leg 128, and to bend the first foreleg 110B with respect to the first leg 108B. This first bending action occurs at the second elbow 130A, the first elbow 132B, and the clip elbow 134. A bending tool has also been used to form a second bend at a first panel second shoulder 136, a second panel first shoulder 138B and a clip shoulder 140. In the second bending action, the second leg 118A is bent with respect to the second trunk 116A, the first leg 108B is bent with respect to the first trunk 106B, and the clip leg 126 is bent with respect to the clip trunk. The seam shown in FIG. 14 is referred to as a quadrilock seam formed by a quadrilock seaming process.

For the triple-lock and the quadrilock seaming processes, there are two options for each process. The first option is to continuously form triple-lock or quadrilock seams along a sidelap of a panel run. As used herein, a panel run is a column length of panels positioned adjacent each other along a line on the roof running from an eave to a peak. The second option is to form triple-lock or quadrilock seams at the clips, but to leave the lengths between the seamed portions with a roll-and-lock seam.

Where triple-lock seams are formed at the clips, or in short segments along a joint, and has roll-and-lock seams elsewhere, this type of seaming is called combination elastic-and-triple-lock seaming, or intermittent triple-lock seaming. Where quadrilock seams are formed at the clips, or in short segments along a joint, and has roll-and-lock seams elsewhere, this type of seaming is called combination elastic-and-quadrilock seaming or intermittent quadrilock seaming. Where continuous triple-lock seams are used with quadrilock seams at the clips, this type of seaming is called combination triple-lock-and-quadrilock seaming.

A given segment of a sidelap joint can be adjusted to a number of wind uplift and water-tightness performance levels by using different seams. That is, a sidelap joint, depending in which zone it is disposed, is formed by the appropriate one of the following:

(1) a quadrilock seam in the eave area where high wind loads occur;

(2) a triple-lock seam up higher on the roof where lesser wind loads occur;

(3) combination elastic-and triple-lock, combination elastic-and-quadrilock, and combination triple-lock-and-quadrilock seams even higher on the roof; and (4) for the rest of the roof, simply a roll-and-lock seam.

Regarding water-tightness, a quadrilock seam may be used in heavy snowdrift areas where water-tightness is particularly important. Other types of seams may be used in less demanding areas for water-tightness.

Generally, the more work energy that must be used on the roof to form a given seam, the more costly and complex is the seaming process, and more the seam is subject to malfunction. The relative work energy and skill required to seam the panels varies from the highest for continuous quadrilock to the lowest for roll-and-lock. The cost generally parallels the relative work energy required to seam the panels together.

Figure 15:
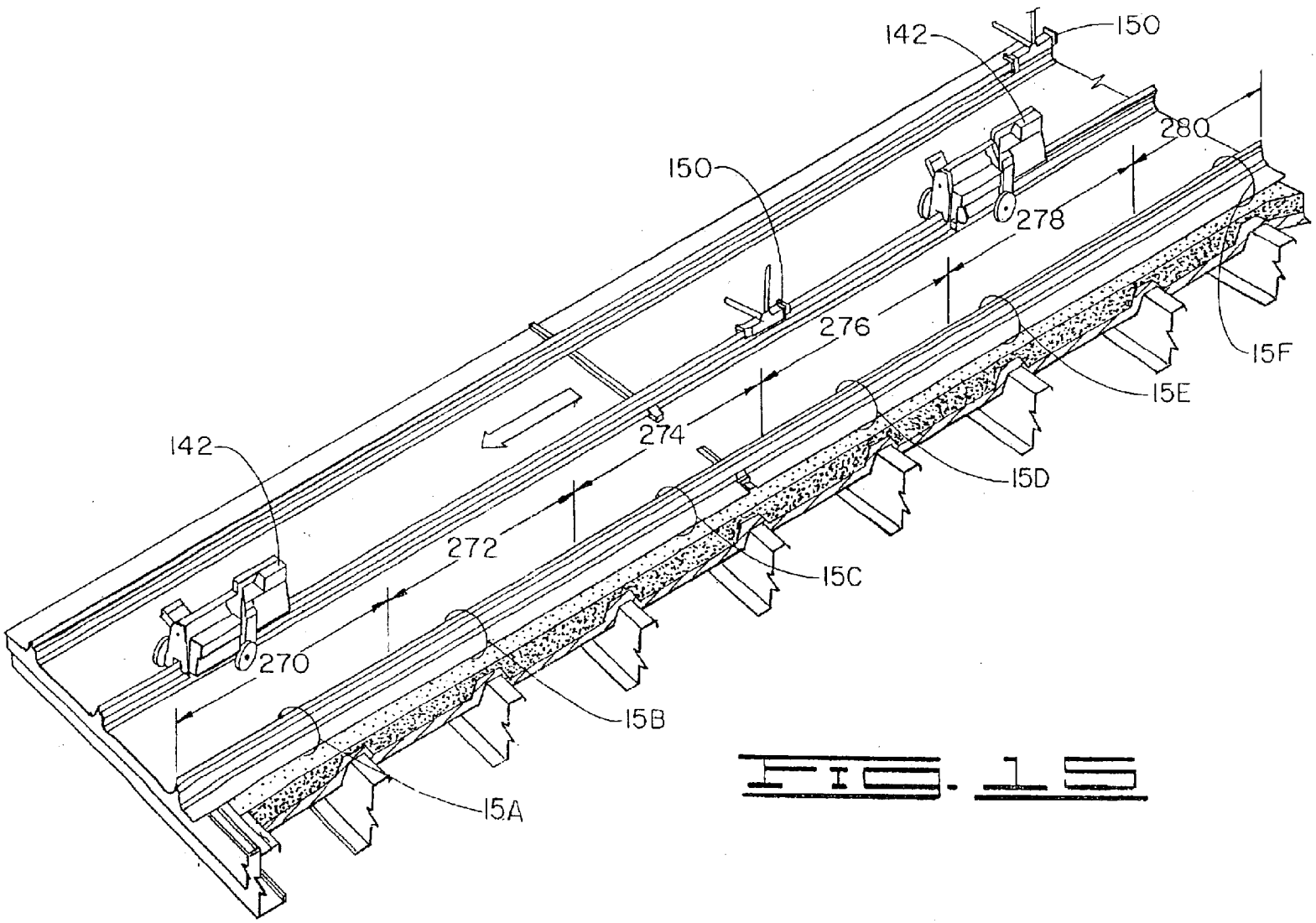
FIG. 15 is a perspective view of two adjacent roof panels, a motorized seamer, and a hand seamer in operation to practice the present invention.

FIG. 15 shows a schematic representation of a motorized seamer 142 and a hand-operated seamer 150 on a metal roof. The motorized seamer 142 is typically used for lengthy runs of continuous seaming. The hand-operated seamer is typically used near the eave, at the ridge and, when desired, at the clips. In some areas of the roof, it is only necessary to have triple-lock seams or quadrilock seams at the clips. The use of continuous seams in these areas of the roof unnecessarily increases the cost of manpower and equipment in providing the roof.

The motorized seamer 142 is used to form a continuous seam along a substantial length of a roof section, and it typically operates by forming a triple-lock on a first pass along the length of a seam. The motorized seamer 142 produces a quadrilock seam by either of two processes, 1) making a second pass along the same seam where a triple-lock has first been formed using a different roll tool, or 2) incorporating the necessary forming tools into the seamer so that the quadrilock pass is made immediately after the triple-lock seam is formed.

As shown in FIG. 15, different seams have been used to achieve different roof quality levels. A section 270 uses a quadrilock seam for its full length because it is subject to large wind uplift forces or watertightness requirements. In the next area up the roof, designated as 272, a combination triple-lock-and-quadrilock seam is used because the wind uplift forces are lower than in the areas below it. In the next area up the roof, designated as 274, a continuous triple-lock seam is used because the wind uplift forces are lower than in the areas below it.

In the next area up the roof, designated as 276, a combination elastic-and-quadrilock seam is used because the wind uplift forces are lower than in the areas below it. In the next area up the roof, designated as 278, a combination elastic-and-triple-lock seam is used because the wind uplift forces are lower than in the areas below it. Finally, in the next area up the roof, designated as 280, the wind uplift forces are the lowest and a roll-and-lock seam is used.

FIG. 15 illustrates how different seams may be used where one encounters different wind uplift forces. Many different seams may be used in many different patterns to most economically meet performance requirements of the different demand zones.

FIGS. 15A–15F depict the profiles of types of seaming corresponding to the details shown in FIG. 15, where FIG. 15B, FIG. 15D and FIG. 15E are shown where the panels connect to the clips.

FIGS. 18 and 19 provide value/cost charts depicting relative wind uplift resistance and watertightness performance, respectively, of different seams in order of increasing cost. These can be used to select the lowest cost level that achieve a required level of performance, other factors being equal, after other required steps have been completed.

The relative roof performance of the different seams may be determined by simulated wind uplift, watertightness and other tests or by analytical means so that they may be used in different areas as appropriate to their cost and performance. The relative in-place cost of each type of seam may be determined for a given roof by means of a cost analysis. It not being necessary to determine the absolute cost, the relative cost will serve to insure the appropriate seam with the minimum cost is chosen and used.

As an example, continuous quadrilock will normally be the most expensive, the cost of the metal roof panel, transportation to the job site and costs other than seaming being equal. This is logical in that quadrilock seams require more work/energy to seam than any of the other seams. The quadrilock seams also require more time to form and are more subject to delays and problems. The quadrilock seams require much greater attention to detail.

On the other hand, the roll and lock seam only requires a relatively simple direct elastic assembly and will cost less than the other seams. The intermittent quadrilock seam, the intermittent triple-lock seam and the continuous triple-lock seam will cost somewhere between the two extremes. Normally the continuous triple-lock seam that requires a relatively expensive on the roof seaming machine, an electrical source and related paraphernalia will cost less than the quadrilock seam, but more than the intermittent quadrilock seam, which at most requires a hand crimp machine to crimp only required portions of the joint between the metal roof panels. The intermittent triple-lock seam requires less work energy than the intermittent quadrilock seam, but more than the simple roll and lock seam.

The relative cost of these seams, other things being equal, will contain the amortization, maintenance and administrative cost of the seaming equipment and the erection time of the person seaming the roof. Power seamers of the type required for this operation normally cost in the $4,000–$8,000 range and require regular periodic maintenance; and there is a considerable administrative cost in scheduling and shipping to and from the job site. Hand crimpers are much less costly, ranging from about $100 to $200 each, and are easier to ship and maintain.

Labor costs to seam the panels vary widely depending on a number of geographic, and union factors. For example, such costs can range from a low in some non-union projects to a high in some union or government projects. Thus, the importance of seamer and labor costs may vary for each project and are dependent on the erection procedure, equipment and personnel required to transport, place and install the panels on the roof. A suitable method of selecting the lowest cost seam that meets the requirements of the roof zone under consideration may be achieved using tables as shown in FIGS. 18 and 19. Similar tables to those shown FIGS. 18 and 19 may be constructed to represent a cost/function for other performance characteristics.

In building roof construction, it is generally accepted that all roofs leak or structurally fail under severe conditions. Thus, it becomes a matter of establishing the degree of watertightness, live load, wind uplift resistance, diaphragm strength, roof aesthetics or other criteria required in a given set of circumstances for each appropriate section of the roof. Following this, the best combination of roof features is selected to achieve the desired quality at a minimum cost level. Any one or any combination of performance criteria can be chosen as the ones to construct at least cost.

The method for providing a metal roof for a building begins by identifying and mapping wind zones of the roof. Next, the type of seaming to be utilized is selected for different wind zones of the roof. Next, the metal panels are installed on the roof support structure, using fasteners to secure the panels to underlying roof support members. When installing the metal panels, the panels are elastically seamed together by the roll-and-lock seam. Finally, the selected process for each pair of metal panels is used to seam every adjacently engaged panel.

Thus, the lowest cost seam that meets the requirement for wind uplift in the zone under consideration will be employed unless the zone is controlled by other considerations such as watertightness.

With regard to watertightness, commercial building roofs can be divided into those areas most likely to leak and consequently requiring the most watertight roof seam. Generally, the roll-and-lock will be the most likely seam to leak under adverse conditions; the combination elastic-and-triple-lock seam will be more water resistant; and the continuous quadrilock seam will be the most water resistant.

The chart of FIG. 19 provides a watertightness value/cost comparison denoting a series of seams with different resistance to water penetration ranked in order of increasing cost.

Although the steps of the method of the invention are described and claimed in a particular order, there is no reason that some of the steps cannot be performed in a different order. For example, one can install all the panels, then identify and map the wind zones of the roof. No ordering of the steps should be implied from the order in which the steps are presented. Only those steps which inherently require order should be inferred from the order in which the steps have been presented or claimed. For example, one has to choose which seaming process one wishes to use before seaming the side-adjacent panels together.

The present invention provides a roofing system based on attribute and zone determination, by which a roof is erected from metal panels or the like that are inter-connected to each other and to the supporting structures by variously selected connecting processes that provide designated quality characteristics for each area zone of the roof. While particular embodiments have been presented by way of illustration, it is understood that such embodiments are illustrative, and not restrictive. Thus, changes and modifications may be made without departing from the spirit and scope of the invention as defined by the claims that follow.

What is claimed is:

1. A roof demand and zone based roofing method for constructing a roof of panels for a building having a roof support structure, the roof having a plurality of demand zones, each demand zone having at least one roof demand, the method comprising:

(a) identifying and mapping the plurality of demand zones of the roof;

(b) choosing a process for seaming side adjacent panels to form joints there between for the panels in each demand zone so that the seaming process chosen for each demand zone will satisfy or exceed the roof demands of that demand zone, and whereby the chosen seaming process for that demand zone differs from the seaming process for at least one other demand zone of the roof; and (c) installing the panels on the roof support structure according to the seaming process chosen for each demand zone of step (b), thereby covering the roof support structure with panels.

2. The method of claim 1 wherein the panels have identical cross sections prior to installation.

3. The method of claim 1 wherein the demand of at least one of the demand zones is wind uplift.

4. The method of claim 3 wherein the performance ratings of the seamed panels are determined by physical testing.

5. The method of claim 3 wherein the performance quality of the seamed panels are rated differently in accordance with their ability to resist watertightness.

6. The method of claim 1 wherein the demand of at least one of the demand zones is watertightness.

7. The method of claim 1 wherein the demand of at least one of the demand zones is snow load.

8. The method of claim 1 wherein the varying of performance of side-to-side joints of the panels is achieved by varying the seam configuration of a mechanical seamer.

9. A roof demand and zone based roofing method for constructing a roof of metal panels for a building having a roof support structure, the roof having a plurality of demand zones, the method comprising:

(a) identifying and mapping the plurality of demand zones of the roof;

(b) installing the panels on the roof support structure thereby covering the roof support structure with the metal panels;

(c) choosing a process from a plurality of processes for joining side-adjacent panels to form joints there between, wherein the joining process chosen for each demand zone to form a joint between the side-adjacent panels in that demand zone at least satisfies the performance requirements of that particular demand zone, and whereby the chosen joining process for that demand zone differs from the joining process chosen for at least one other demand zone: and (d) installing the metal panels according to the joining process chosen for each demand zone in step (c).

10. The method of claim 9 wherein the panels have identical cross sections prior to installation.

11. The method of claim 9 wherein the demand of at least one of the demand zones is wind uplift.

12. The method of claim 9 wherein the demand of at least one of the demand zones is watertightness.

13. The method of claim 9 wherein the demand of at least one of the demand zones is snow load.

14. The method of claim 9 wherein the varying of performance of side-to-side joints of the panels is achieved by varying the seam configuration of a mechanical seamer.

15. A roof demand and zone based roofing method for constructing a roof for a building having a roof support structure, the roof having a plurality of demand zones, the method comprising the steps of:

identifying the demand zones of the roof;

installing panels to cover at least portions of more than one of the demand zones, one such demand zone requiring less quality than that of another one of the demand zones; and seaming the edges of the panels with different seams to meet the reduced requirements of at least one of the covered portions of the demand zones.

16. The method of claim 15 wherein the panels have identical cross sections prior to installation.

17. The method of claim 15 wherein the demand of at least one of the demand zones is wind uplift.

18. The method of claim 15 wherein the demand of at least one of the demand zones is watertightness.

19. The method of claim 15 wherein the demand of at least one of the demand zones is snow load.

20. The method of claim 15 wherein the varying of performance of side-to-side joints of the panels is achieved by varying the seam configuration of a mechanical seamer.

* * * * *